US008333616B2

(12) United States Patent
Su et al.

(10) Patent No.: US 8,333,616 B2
(45) Date of Patent: Dec. 18, 2012

(54) LOW-PROFILE CABLE ASSEMBLY WITH GOOD FUNCTION EMI PREVENTION

(75) Inventors: Ping-Sheng Su, New Taipei (TW); Xue-Chao Wang, Kunshan (CN); Zhuang-Zhi Wu, Kunshan (CN)

(73) Assignee: Hon Hai Precision Industry Co., Ltd, New Taipei (TW)

( * ) Notice: Subject to any disclaimer, the term of this patent is extended or adjusted under 35 U.S.C. 154(b) by 0 days.

(21) Appl. No.: 13/193,496

(22) Filed: Jul. 28, 2011

(65) Prior Publication Data

US 2012/0028496 A1 Feb. 2, 2012

(30) Foreign Application Priority Data

Jul. 30, 2010 (CN) ..... 2010 2 0277024

(51) Int. Cl.
*H01R 24/00* (2006.01)

(52) U.S. Cl. ..... 439/660; 439/607.41; 439/607.55

(58) Field of Classification Search ..... 439/660, 439/607.5, 607.41, 607.55
See application file for complete search history.

(56) References Cited

U.S. PATENT DOCUMENTS

| | | | | |
|---|---|---|---|---|
| 6,491,550 | B1 * | 12/2002 | Murasawa | 439/660 |
| 7,717,733 | B1 * | 5/2010 | Yi et al. | 439/452 |
| 7,824,222 | B2 * | 11/2010 | Miyoshi et al. | 439/607.41 |
| 8,070,525 | B2 * | 12/2011 | Hou et al. | 439/660 |
| 8,079,878 | B2 * | 12/2011 | Huang | 439/660 |

FOREIGN PATENT DOCUMENTS

CN 2785189 Y 5/2006

* cited by examiner

*Primary Examiner* — Hien Vu
(74) *Attorney, Agent, or Firm* — Wei Te Chung; Ming Chieh Chang

(57) ABSTRACT

A cable assembly includes an insulative housing, a plurality of conductive terminals received in the insulative housing, a cable having a shielding braid and a number of wires electrically connected to the conductive terminals, a metal shell enclosing the insulative housing and a grounding flake made of metal material, connected to the shielding braid of the cable and attached to the inner surface of the metal shell.

14 Claims, 4 Drawing Sheets

LOW-PROFILE CABLE ASSEMBLY WITH GOOD FUNCTION EMI PREVENTION

FIELD OF THE INVENTION

The present invention relates to a cable assembly, and more particularly to a cable assembly with a metal shell.

DESCRIPTION OF PRIOR ART

At present, a cable assembly is always designed to be smaller and smaller. The requirement preventing from EMI and stabilizing signal don't decrease. CN Pat. No. CN2785189Y, issued on May 13, 2006, discloses a cable assembly having a metal shell. The metal shell includes a front shell for mating to a complementary connector, an upper shell and a lower shell assembled on the upper shell. The upper and lower shell both have a pair of upper and lower clamping flakes extending from a rear end thereof. Two screws lock the upper and lower clamping flakes for fixing a cable. The cable assembly can improve the function of preventing EMI, but with the smaller trend of the cable assembly, it can not provide a space installing the screw or other fastener.

As discussed above, a new cable assembly overcoming the shortages of existing technology is needed.

SUMMARY OF THE INVENTION

Accordingly, an object of the present invention is to provide a low-profile cable assembly with good function EMI prevention.

In order to achieve the above-mentioned objects, a cable assembly comprises an insulative housing, a plurality of conductive terminals received in the insulative housing, a cable having a shielding braid and a number of wires electrically connected to the conductive terminals, a metal shell enclosing the insulative housing and a grounding flake made of metal material, connected to the shielding braid of the cable and attached to the inner surface of the metal shell.

Other objects, features and advantages of the invention will be apparent from the following detailed description taken in connection with the accompanying drawings.

DETAILED DESCRIPTION OF PREFERRED EMBODIMENTS

Figure 1:
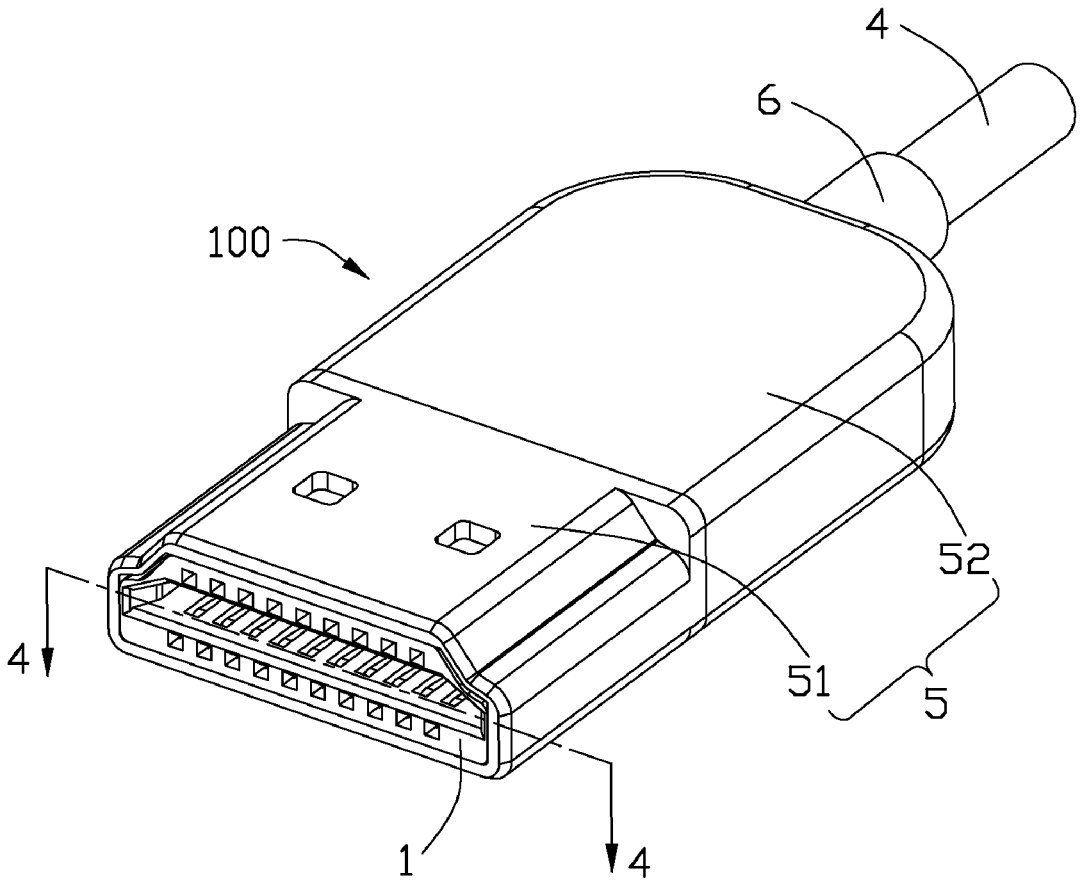
FIG. 1 is a perspective view of a cable assembly in accordance with the present invention.

Reference will now be made to the drawing figures to describe the present invention in detail.

Figure 2:
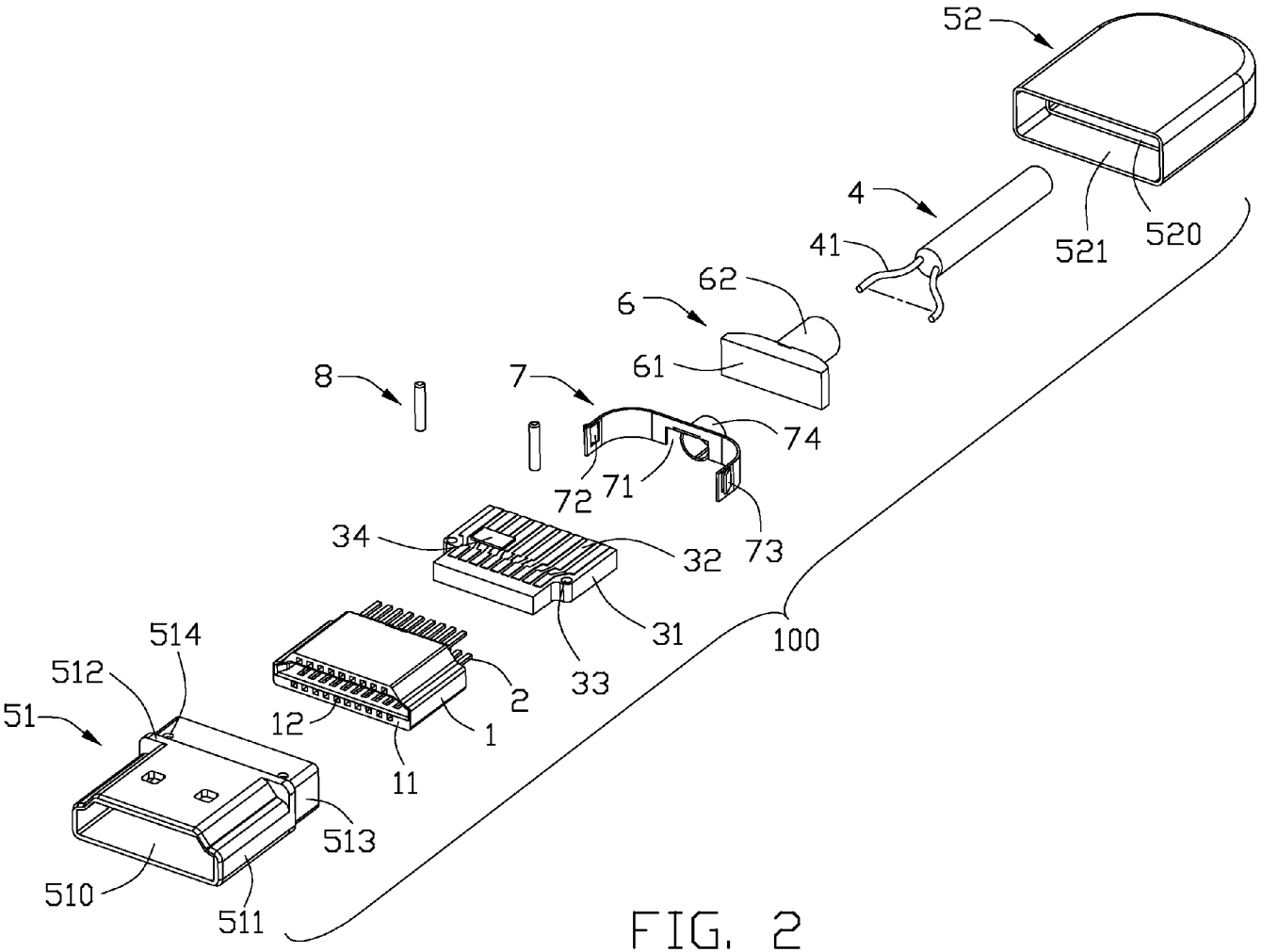
FIG. 2 is an exploded, perspective view of the cable assembly shown in FIG. 1.
Figure 3:
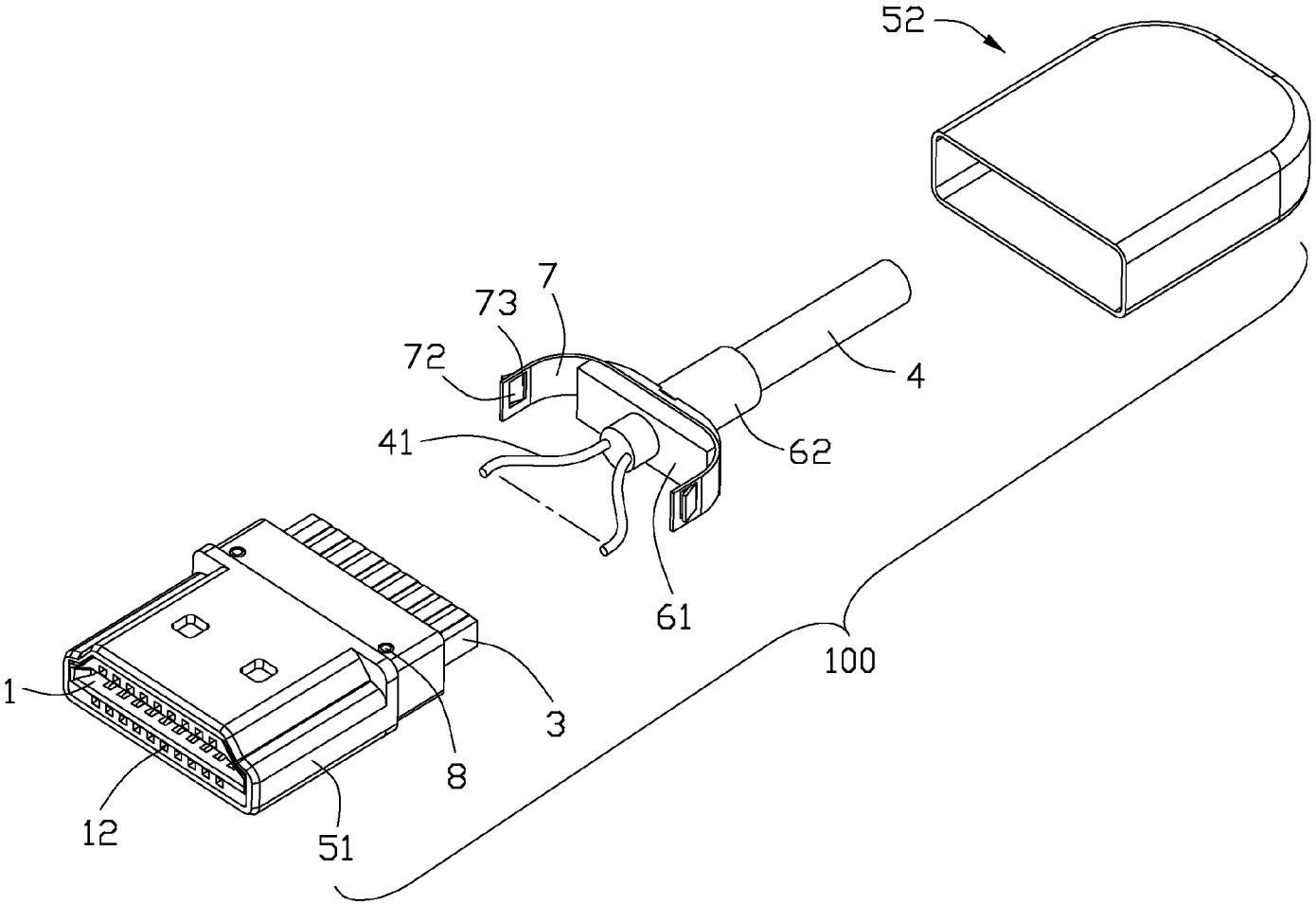
FIG. 3 is an assembled perspective view of part components of the cable assembly of the present invention.
Figure 4:
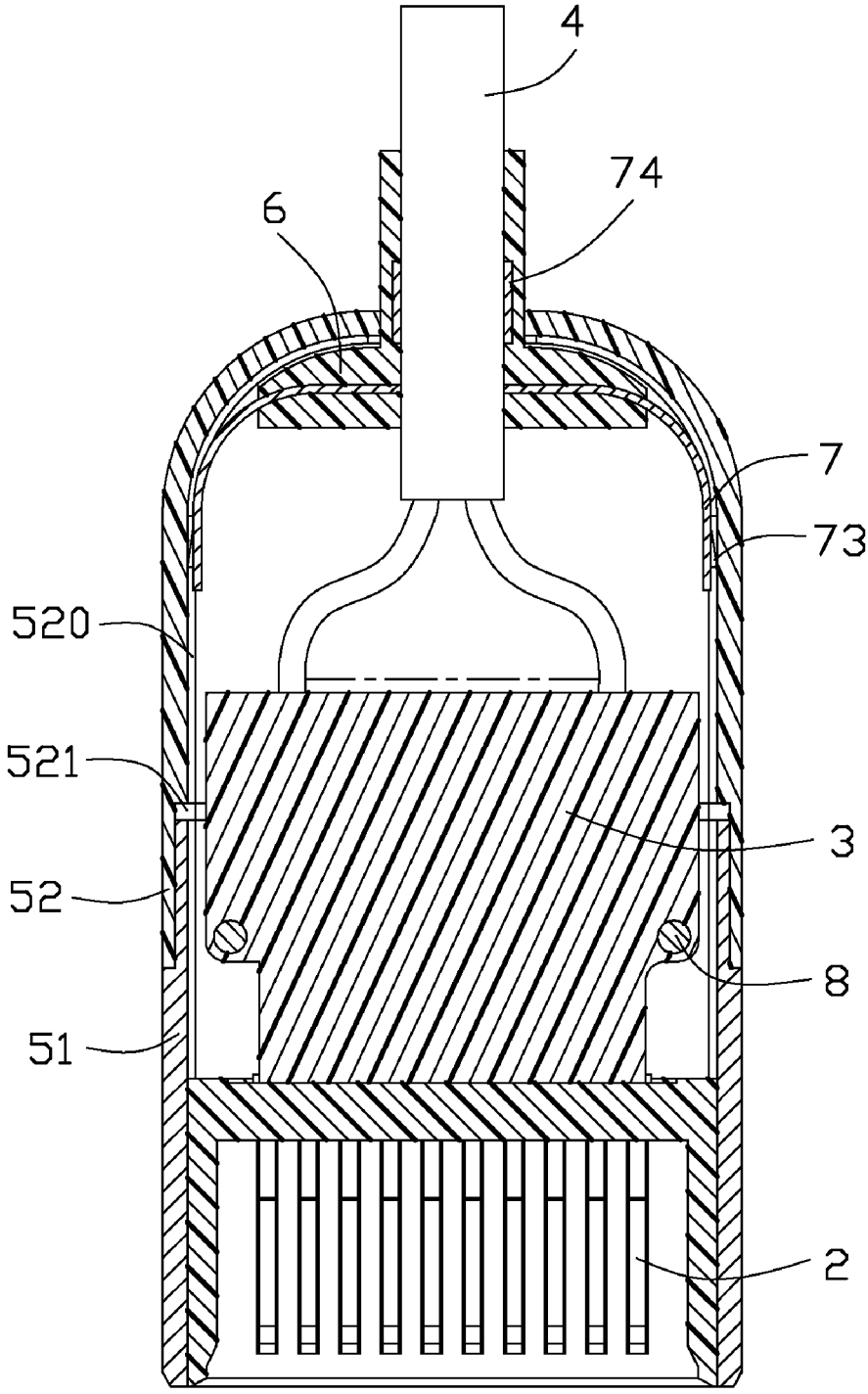
FIG. 4 is a cross section view of the cable assembly of FIG. 1 taken along line 4-4.

Referring to FIGS. 1 to 4, a cable assembly 100 in accordance with the present invention comprises an insulative housing 1, a number of conductive terminals 2 received in the insulative housing 1, a PCB 3 assembled in the rear end of the insulative housing 1, a cable 4 having a number of wires 41 and a shielding braid (not shown), a metal shell 5 enclosing the insulative housing 1, a strain relief 6 molded on the outer surface of the cable 4, a grounding flake 7 accommodated in the metal shell 5 and a pair of fixed columns 8.

The insulative housing 1 has a trapeziform mating space 11 surrounded by four walls and located on a front end thereof for mating to a complementary connector (not shown). An upper and lower wall of the insulative housing 1 defines respectively a plurality of conductive slots 12 communication with the mating space 11 for receiving the conductive terminals 2. Each of the conductive terminals 2 is inserted into the front end of the insulative housing 1 from the rear end of the insulative housing 1 along the conductive slot 12 and stretched into the mating space 11 for electrically mating to the complementary connector. The rear end of the conductive terminal 2 is soldered on the surface of the PCB 3.

The PCB 3 comprises a substrate 31, a plurality of conductive film 32 located on the upper and lower surfaces of the substrate 31, a pair of fixed holes 33 are run through the upper and lower surfaces of the substrate 31 and some electronic elements 34 for decreasing EMI.

The metal shell 5 is made of metal material, which is Zinc Alloy in accordance with the present invention. The metal shell 5 comprises a front shell 51 and a rear shell 52 installed on the front shell 51. The front shell 51 with no-joint-line surface comprises a box-shaped base portion 511 matching the profile of the insulative housing 1, a receiving space 510, a mating portion 513 located on the rear end thereof and a connecting portion 512 connecting the mating portion 513 and the base portion 511. A pair of through holes 514 are formed on the mating portion 513. The through holes 514 run through the upper and lower surface of the mating portion 513 to respectively correspond to the fixed holes 33 of the PCB 3.

The rear shell 52 with no-joint-line surface is made of Zinc Alloy. The rear shell 52 has a receiving room 520 receiving the strain relief 6, the grounding flake 7 and the fixed columns 8. A receiving groove 521 is formed in the front end of the receiving room 520 for receiving the mating portion 513 of the front shell 51.

The U-shaped grounding flake 7 is made of metal material. The grounding flake 7 comprises a gap 71 located on the middle rear end thereof to provide a passing through for the cable 4, a pair of cutouts 72 respectively located on two sides thereof, a pair of springs 73 respectively received in the cutout 72 and a ring 74 extending backwardly from the rear end thereof. The springs 73 attach to the inner wall of the rear shell 52.

The strain relief 6 made from insular material is over molded on the cable 4 and includes a rectangular first portion 61 and a cylindrical second portion 62. Before the strain relief 6 is molded, an insular skin (not shown) of the cable 4 is removed partly, the shielding braid (not shown) is turned over and enclosing the insular skin remained on the cable 4. The cable 4 passes through the ring 74 of the grounding flake 7 and the ring 74 of the grounding flake 7 retains on surface of the shielding braid on the insular skin. The grounding flake 7 and the cable 4 are put in a molding to mold the strain relief 6 together. After molded, the first portion 61 of the strain relief 6 clamps the grounding flake 7 and encloses the cable 4 and the second portion 62 encloses the cable 4. The springs 73 is exposed on front of both side of the strain relief 6.

In assembly, the front end of the conductive terminals 2 are inserted into the mating space 11 and the rear end of the conductive terminals 2 are exposed on rear of the insulative housing 1. The wire 41 of the cable 4 enclosed the strain relief 6 is soldered on conductive film 32 of the PCB 3, the cable 4 is connected electrically to the PCB 3. The front end of the PCB 3 is inserted into the rear of the insulative housing 1. The rear end of the conductive terminals 2 are soldered respectively on conductive film 32 on the upper and lower surface of the substrate 31. The insulative housing 1 is inserted into the receiving space 510 of the front shell 51 from the rear end of the mating portion 513 of the front shell 51. The fixed holes 33 of the PCB 3 are aligned to the through hole 514 of the front shell 51 and the fixed column 8 is received in the holes for retaining the PCB 3. The fixed columns 8 don't exceed the outer surface of the mating portion 513. The rear shell 52 is assembled on the front shell 51 with the mating portion 513 of the front shell 51 received in the receiving groove 521 of the front shell 52. The mating portion 513 is interference with the receiving groove 521 for the front shell 51 being firmly fastened on the rear shell 52. the upper and lower wall of the front shell 51 and the rear shell 52 are aligned.

The spring 73 is attached to the inner face of the rear shell 52 for the cable assembly 100 having good function of preventing EMI. It is better function of preventing EMI of the metal shell with no-joint-line surface than the metal shell with joint-line.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

an insulative housing having a mating port;

a plurality of conductive terminals received in the insulative housing;

a cable having a shielding braid and a number of wires connected electrically respectively to the conductive terminals;

a metal shell enclosing the insulative housing; and a grounding flake made of metal material, connected to the shielding braid of the cable and attached to the inner surface of the metal shell;

wherein the metal shell comprises a front shell with no-joint-line surface enclosing the insulative and a rear shell with no-joint-line surface assembled on the front shell;

wherein the grounding flake is U-shaped and comprises a pair of cutouts located respectively on the two sides thereof and a pair of springs respectively received in the cutouts and attaching to inner surface of the rear shell;

wherein the grounding flake comprises also a gap to provide a passing through for the cable and a ring extending backwardly from the middle rear thereof and retaining the shielding braid of the cable; and wherein the cable assembly comprises also a strain relief enclosing the grounding flake and the cable.

2. The cable assembly as recited in claim 1, wherein the strain relief includes a rectangular first portion and a cylindrical second portion.

3. The cable assembly as recited in claim 2, wherein the first portion clamps the grounding flake and the second portion encloses the cable.

4. The cable assembly as recited in claim 3, wherein the front shell comprises a mating portion located on the rear therein, the rear shell comprises a receiving groove receiving and interference with the mating portion.

5. The cable assembly as recited in claim 4, wherein the cable assembly comprises also a PCB installed on the rear end of the insulative housing, a pair of fixed holes are formed on the PCB, a pair of through holes are formed on the front shell.

6. The cable assembly as recited in claim 5, wherein the cable assembly comprises also a pair of fixed columns run through the fixed holes and the through holes for retaining the PCB.

7. The cable assembly as recited in claim 6, wherein the fixed columns don't exceed the outer surface of the mating portion.

8. The cable assembly as recited in claim 7, wherein the rear shell defines a receiving room receiving the strain relief, the grounding flake and fixed columns.

9. The cable assembly as recited in claim 8, wherein the receiving groove located in the receiving room.

10. The cable assembly as recited in claim 1, wherein the metal shell is made of Zinc Alloy.

11. The cable assembly as recited in claim 1, wherein the upper and lower wall of the front shell and the rear shell are aligned.

12. A cable connector assembly comprising:

an insulative housing defining a mating port;

a plurality of contacts disposed in the housing;

a cable defining an insular skin enclosing a shielding braid which further encloses therein a plurality of wires electrically connected to the corresponding contacts, respectively;

a strain relief integrally overmolded upon the cable;

a metallic shell located behind the mating port of the housing; and a grounding flake integrally formed with the strain relief;

wherein said grounding flake mechanically and electrically contacts an interior of the shell;

wherein the grounding flake is U-shaped and comprises a pair of cutouts located respectively on the two sides thereof and a pair of springs respectively received in the cutouts and attaching to inner surface of the metallic shell;

wherein said grounding flake defines a ring embedded within a cylindrical section of the strain relief, and the U-shaped section located in front of the ring;

wherein the U-shaped section is embedded in a rectangular section of the strain relief which is located in front of the cylindrical section.

13. The cable connector assembly as claimed in claim 12, wherein the grounding flake further contacts the shielding braid in the strain relief.

14. The cable connector assembly as claimed in claim 12, wherein the shielding braid is folded backward upon the insular skin and inwardly pressed by the ring.

* * * * *